United States Patent [19]

Bulso, Jr. et al.

[11] Patent Number: 4,782,685

[45] Date of Patent: Nov. 8, 1988

[54] APPARATUS FOR FORMING TALL TAPERED CONTAINERS

[75] Inventors: Joseph D. Bulso, Jr., Canton; James A. McClung, North Canton, both of Ohio

[73] Assignee: Redicon Corporation, Canton, Ohio

[21] Appl. No.: 129,482

[22] Filed: Dec. 7, 1987

[51] Int. Cl.[4] ..... B21D 22/20

[52] U.S. Cl. ..... 72/349

[58] Field of Search ..... 72/58, 339, 347, 348, 72/349

[56] References Cited

U.S. PATENT DOCUMENTS

| | | | |
|---|---|---|---|
| Re. 1,183 | 5/1861 | Seymour | 72/349 |
| 51,883 | 1/1866 | Wells | 72/349 |
| 1,967,245 | 7/1934 | Hothersall | 72/349 |
| 2,318,819 | 5/1943 | Verson | 72/349 |
| 3,695,084 | 10/1972 | Siemonsen et al. | 72/348 |
| 3,786,667 | 1/1974 | Garnett, Jr. | 72/348 |
| 3,811,393 | 5/1974 | Close | 113/120 R |
| 3,814,040 | 6/1974 | Habash | 113/120 M |
| 4,051,707 | 10/1977 | Valek et al. | 72/348 |
| 4,102,467 | 7/1978 | Woodley | 220/67 |
| 4,184,444 | 1/1980 | Woodley | 113/120 X |
| 4,263,800 | 4/1981 | Arfert et al. | 72/349 |
| 4,366,696 | 1/1983 | Durgin et al. | 72/339 |
| 4,386,514 | 6/1983 | Herten | 72/347 |
| 4,503,702 | 3/1985 | Bulso, Jr. et al. | 72/349 |

FOREIGN PATENT DOCUMENTS

| | | | |
|---|---|---|---|
| 526882 | 9/1956 | Belgium | 72/349 |
| 1215799 | 3/1986 | U.S.S.R. | 72/349 |

*Primary Examiner*—E. Michael Combs

*Attorney, Agent, or Firm*—Reese Taylor

[57] ABSTRACT

A method of forming a tapered container in which the container is first redrawn to a partial length having first and second straight sidewall portions interconnected by a transition position and then redrawn to substantially its final length and tapered condition by drawing material from the transition portion. The method also optionally includes an overlength second redraw and a bottom profiling step utilizing the overdrawn portion to form the profile. The apparatus includes a plurality of stations wherein the redrawing is accomplished in the first instance with a tapered punch and straight walled die and in the second instance with a tapered punch and tapered die.

10 Claims, 7 Drawing Sheets

APPARATUS FOR FORMING TALL TAPERED CONTAINERS

FIELD OF THE INVENTION

This invention relates, in general, to tapered containers formed from metal or other material and used for food or beverages and relates, in particular, to a method and apparatus for forming relatively tall tapered containers by a drawing and redrawing method with such containers being capable of being nested or stacked for transportation.

DESCRIPTION OF THE PRIOR ART

In some industries, metal containers or cans are actually made or formed at one location and shipped to another location where they are filled with the product.

In the past, when most containers of this type were made in what is commonly called a three-piece method with a top, bottom, and body, remote fabrication of the containers presented relatively minor problems. In that situation, the tops and bottoms and the body were formed at the first location with the can body flattened out and shipped flat. Therefore, efficient use of shipping space was readily possible. With that system, at the site at which the container was to be filled, the container body could be formed to its final cylindrical configuration and welded following attachment of the bottom, filling of the container and attachment of the top.

More recently, the soldered or welded seam of the three-piece container has become somewhat objectionable, because of the fact that the seam has to be coated with a special material and, in addition to the obvious expense of such special coating, coating adhesion problems also often arise.

Accordingly, large segments of various industries have moved to the so-called "two-piece" can wherein one drawn piece constitutes the cylindrical container body and bottom wall and a second piece comprises the top.

These containers, of course, are imminently suitable for the purposes for which they are used and have found wide acceptance. As already mentioned, however, in many instances, the containers are still actually manufactured at one location and filled in another and with the two-piece container, serious shipping problems are created because the containers cannot be flattened out for shipping purposes after having been drawn and redrawn to the final cylindrical body configuration.

The obvious difficulty is that each container occupies a given cubic space and, therefore, that cubic volume, in large quantities, is substantial, making shipping costs excessive.

A solution to this problem has been to provide a container wherein the body is tapered from top to bottom so that these containers can nest one within the other. In this way, more efficient use of shipping space is achieved. One example of such an approach can be seen in Durgin U.S. Pat. No. 4,366,696.

There are, however, still problems present, because it is important that the containers do not stick together, and it is also difficult to draw a tapered wall while avoiding wrinkles and maintaining uniform wall thickness.

Thus, while tapered containers capable of nesting or stacking have been constructed of molded plastic, as can be seen in Woodley U.S. Pat. Nos. 4,102,467 and 4,184,444, and tapered containers have been produced by impact extrusion, as can be seen in Habash U.S. Pat. No. 3,814,040, the wrinkling problems encountered with drawing metal still exist.

The Durgin Patent referred to above represents one solution in that wrinkling is permitted in the first stage operation and then eliminated by diametrically expanding the container in a second stage.

Another solution, particulary applicable to relatively short containers, can be seen in Bulso U.S. Pat. No. 4,503,702 wherein a two-stage drawing operation is employed with the container being first drawn and tapered to about one-half of its final heighth, following which it is drawn to its final heighth in a second operation.

While this approach is satisfactory, particularly with regard to relatively short containers, it has been found that difficulties are encountered when it is attempted to employ this process with tall containers.

In that regard, for purposes of this application, a "short" container may be said to be one in which the heighth does not exceed the diameter while a "tall" container is one in which it does.

To form a tall container according to the teachings of the just-mentioned Bulso patent would require a large number of repeated short draws. That is because each succeeding die is diametrically larger and, with a tapered punch, there is a tendency to lose control of the material between the punch and the die thereby causing wrinkling in the container wall. This could only be avoided, if at all, by a laborious series of short draws.

Further prior art of general interest with regard to tapered containers in general can be seen in Seymour U.S. Pat. No. 1,183; Siemonsen U.S. Pat. No. 3,695,084; Garnett U.S. Pat. No. 3,786,667; Close U.S. Pat. No. 3,811,393; Valek U.S. Pat. No. 4,051,707; and Arfert U.S. Pat. No. 4,263,800.

It is believed, however, that none of these prior art patents effectively disclose a method and apparatus for forming a wrinkle-free, uniform thickness, tapered, relatively tall container by the draw and redraw method.

SUMMARY OF THE INVENTION

It has been discovered that a satisfactory tall, tapered container can be produced by subjecting the same to a short series of draws and redraws wherein the final heighth of the container is achieved only through such drawing operations and wherein the taper is imparted only in the latter stages of the operation.

It is, therefore, the principal object of this invention to provide a method and apparatus for producing a tall, tapered container by drawing and redrawing wherein the container wall is wrinkle free and the container has a suitable taper for nesting and stacking while being capable of being labelled with conventional labelling equipment notwithstanding its tapered nature.

Accordingly, production of an improved tapered container and the method and apparatus for its manufacture becomes the principal object of this invention with other objects thereof becoming more apparent upon consideration of the following specification considered and interpreted in view of the accompanying drawings.

OF THE DRAWINGS

BRIEF DESCRIPTION OF THE PREFERRED EMBODIMENTS

Figure 1:
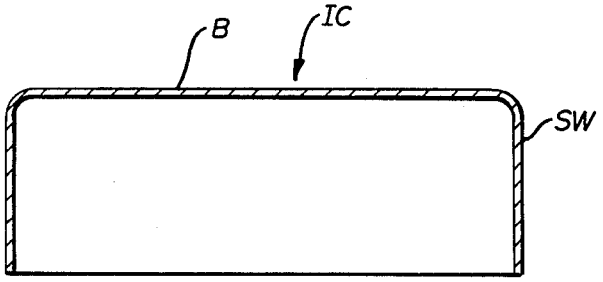
FIGS. 1 through 7 are sectional views of the container at various stages of its formation.

Before describing the method and apparatus for forming the finished product, attention is first called to FIGS. 1 through 7 of the drawings wherein the configuration of the container at various stages is illustrated.

It will be assumed that the container is essentially to be formed from a blank of material, such as metal or plastic, which would be generally circular in plan, and the blanking step of the overall operation is not illustrated in the drawings being well within the knowledge of one of ordinary skill in this art.

Figure 9:
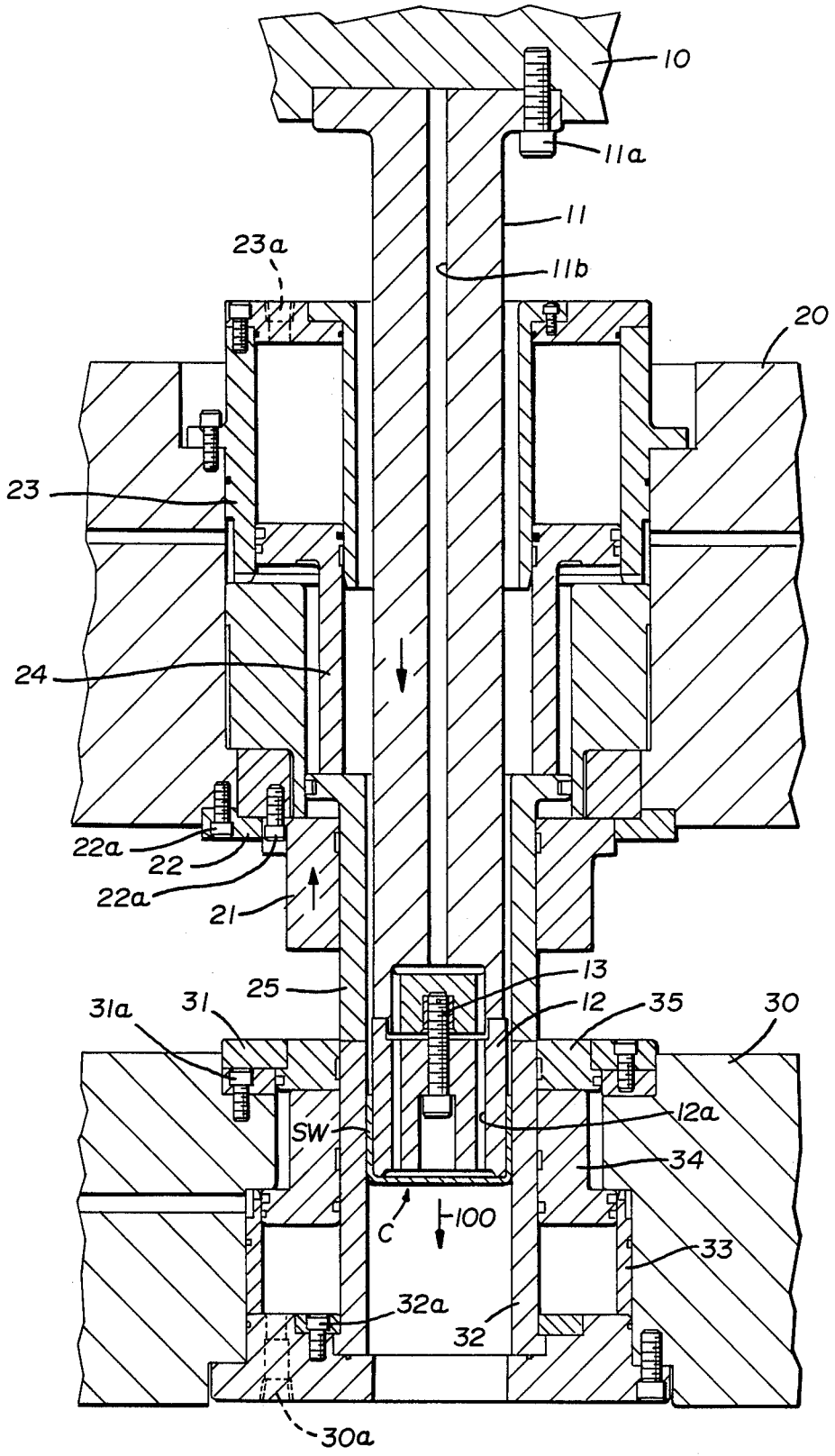
FIG. 9 is a sectional elevational view of the apparatus at the first station following reverse drawing of the inverted cup.

It should be noted, however, that the essential invention disclosed herein could be practiced beginning with the operation shown in FIG. 9 of the drawings. In other words, cup C could be formed conventionally to the configuration of FIG. 2 and then transferred to the apparatus of this invention. What is illustrated and described herein, then, is a combination of two operations.

Therefore, referring to FIG. 1, it will be assumed that a blank of material constituting the starting workpiece has been provided from a sheet or coil and that blank has been formed into an inverted cup IC having a bottom or center panel B and a sidewall SW.

Figure 2:
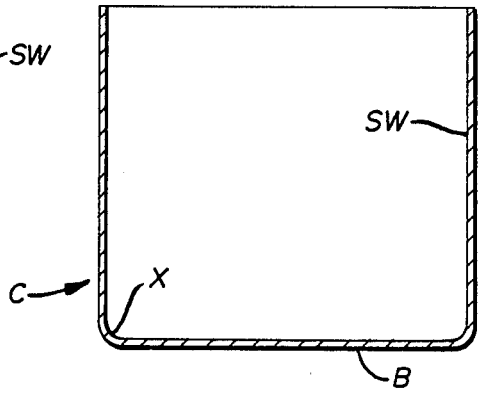

In FIG. 2, it will be seen that the inverted cup IC has been effectively turned inside out and deepened to form the cup C, again having a bottom B and a sidewall SW.

Figure 3:
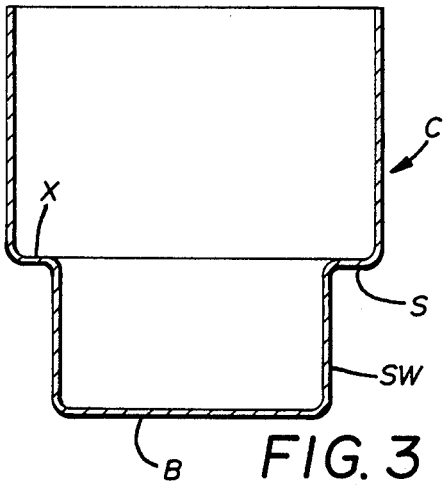

FIG. 3 of the drawings illustrates the second effective redraw of the press wherein a shoulder S is formed, as will be described subsequently, and wherein the cup has begun to assume its final length dimension. It will be noted that this sidewall SW, however, is straight at this point.

Figure 4:
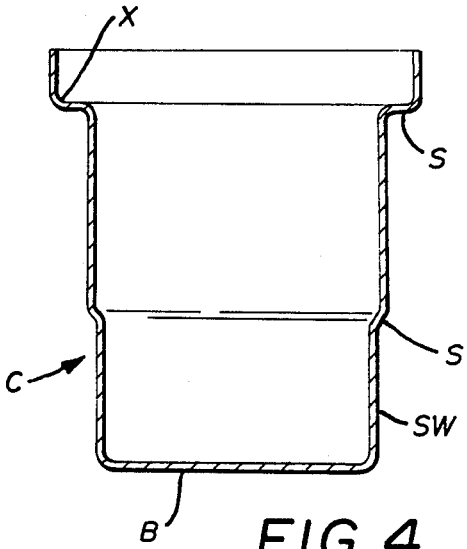

Referring next then to FIG. 4, it will be seen that the cup C has been further redrawn, still maintaining the shoulder S and further elongating the sidewall SW with the sidewall retaining its essentially straight condition.

Effectively, some of the material in the shoulder S has been pulled out by the draw. However, a transitional bead or wrinkle W has been retained and interconnects two straight portions of sidewall SW.

Figure 5:
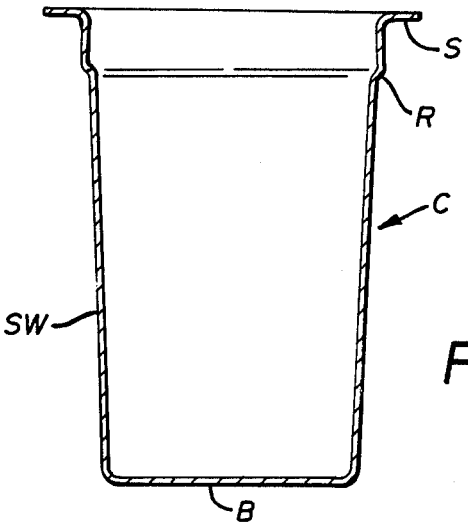

FIG. 5 represents a further elongation of the cup C, setting the annular external ridge R for purposes which will be described below, but elongating the sidewall SW to its final desired length and imparting the taper which would be in the nature of 1.5°. Here, the remaining material in the transitional bead or wrinkle W has been pulled out.

Figure 6:
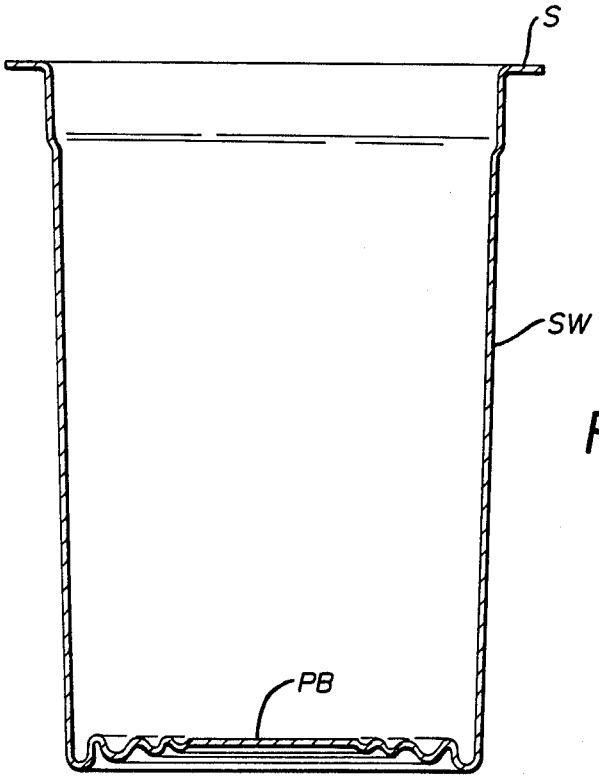
Figure 7:
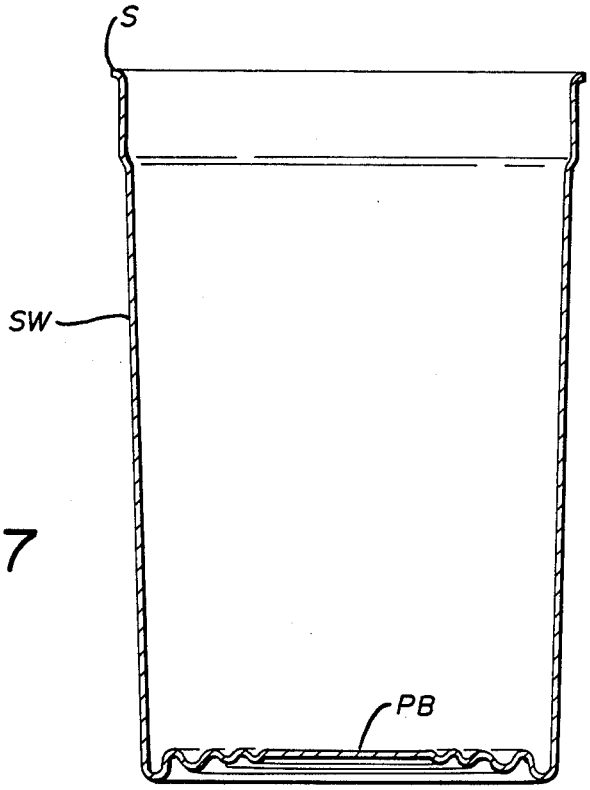

FIG. 6 illustrates an optional step in the manufacturing process wherein the formerly flat bottom B has been profiled to form a profiled bottom PB, while FIG. 7 illustrates the possible final configuration of the container wherein the flange area which was formerly part of the shoulder S has been trimmed.

Turning then to FIGS. 8 through 14 for a description of the apparatus and method necessary to form the container, it will again be noted that the blanking step has been omitted.

Figure 8:
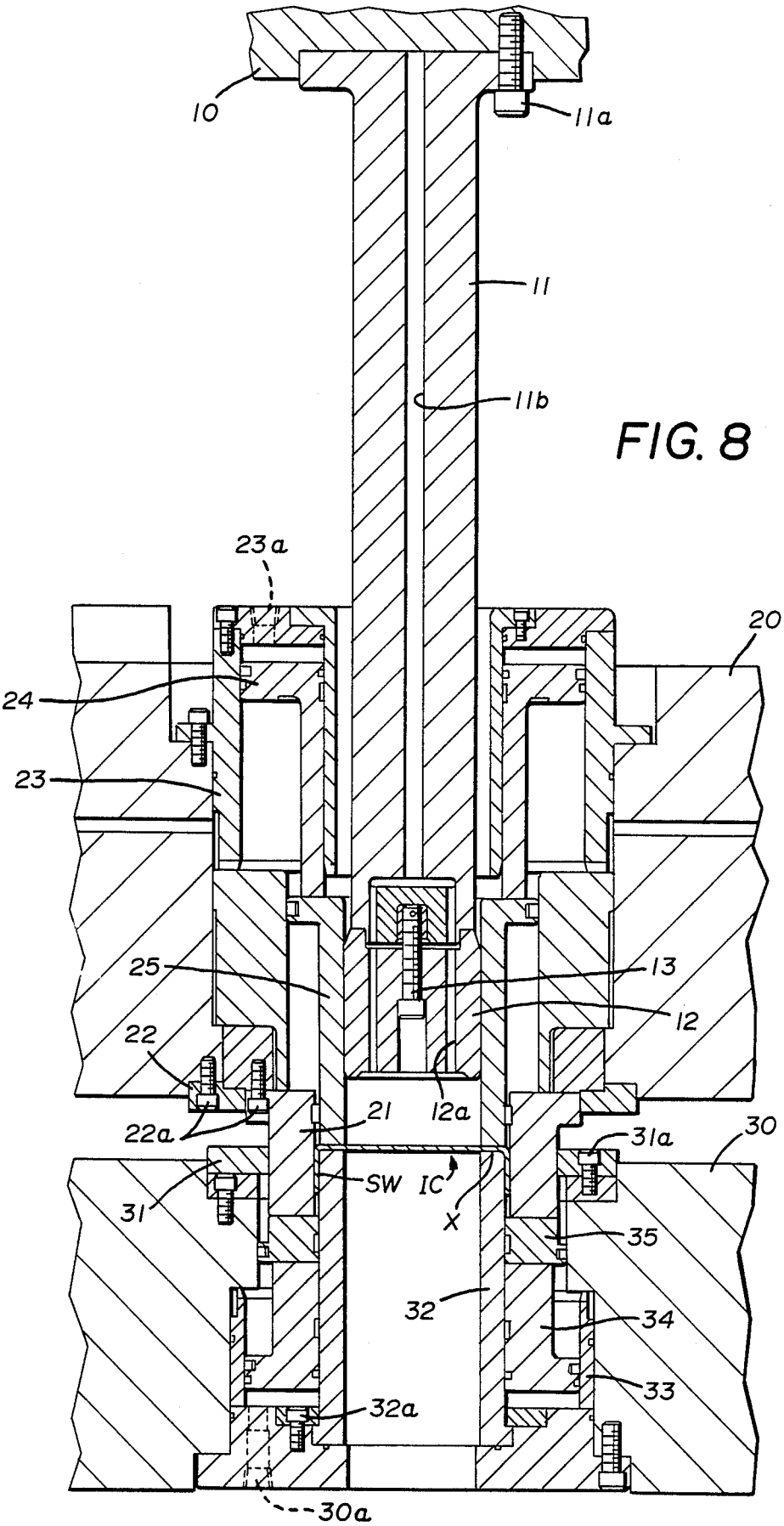
FIG. 8 is a sectional elevational view showing the position of the apparatus at the first station following forming of the inverted cup.

Accordingly, FIG. 8 illustrates apparatus which is incorporated into a double acting press of the type generally disclosed in Ridgway U.S. Pat. No. 3,902,347 and having movable inner and outer slides which reciprocate toward and away from a fixed base and wherein the timing of the movement of each can be independently controlled.

To that end, an inner die holder 10 carries a die center riser 11 secured thereto by suitable screws **11*a*. On the projecting end of the die center riser 11, a die center 12 is secured by a screw 13, while connecting air passages 11*b* and 12*a* are provided in the riser 11 and die center 12**.

The outer slide of the press carries an outer die holder 20 and a blank and draw punch 21 is secured thereto by a punch retainer 22 and suitable screws **22*a***.

An upper cylinder 23 is carried by the outer die holder 20 and an upper piston 24 reciprocates within that cylinder under fluid pressure through port **23*a*. Disposed below the upper piston 24, in stacked relationship therewith, is a pressure sleeve 25 which is, again, movable under pressure from piston 24 toward the fixed base 30**.

The fixed base of the press, generally indicated by the numeral 30, carries a blank cut edge 31 secured thereto by suitable screws **31*a*. The fixed base 30 also has a central die cavity and, in the first stage illustrated in FIGS. 8 and 9, a lower cylinder 33 is disposed in that cavity. Within the cylinder 33 is a lower piston 34 and a draw pad 35 carried on the top of that piston which is fluidly actuated through port 30*a*. Still further inboard of lower piston 34 is a first redraw die 32 fixed to the base 30 by screws 32*a*. This die 32** is hollow for purposes which will become apparent.

As can be seen in FIG. 8, advancement of the outer die holder 20 toward the base 30 causes the blank and draw punch 21 to wipe the sidewall SW of the container about the top of the first redraw die 32 to form the inverted cup IC illustrated in FIGS. 1 and 8.

It will be noted that a pressure sleeve 25 is in engagement with the bottom B of the inverted cup at this point in an area designated by the letter X (see FIG. 2).

Turning then to FIG. 9, it will be seen that further advance of the die center 12 toward the fixed base 30 will cause die center 12 to be inserted into hollow die 32 and effectively invert the cup, pulling it over the top of the first redraw die 32 to form the cup C in the configuration shown in FIGS. 2 and 9 of the drawings. The fluid actuated clamp between pressure sleeve 25 and die 32 will also serve to avoid pinching as the sidewall SW is pulled from between these surfaces. The timing of the double acting press causes blank and draw punch 21 to begin lift away and ultimately engage sleeve 25 to carry it away also.

Formation of cup C is thus completed at this station and the cup can be removed from die center 12 by air through air passages 11b and 12a and, the die 32 being hollow, the cup C can be removed in the direction of arrow 100 to a conveyor or other suitable transfer means beneath the die.

Figure 10:
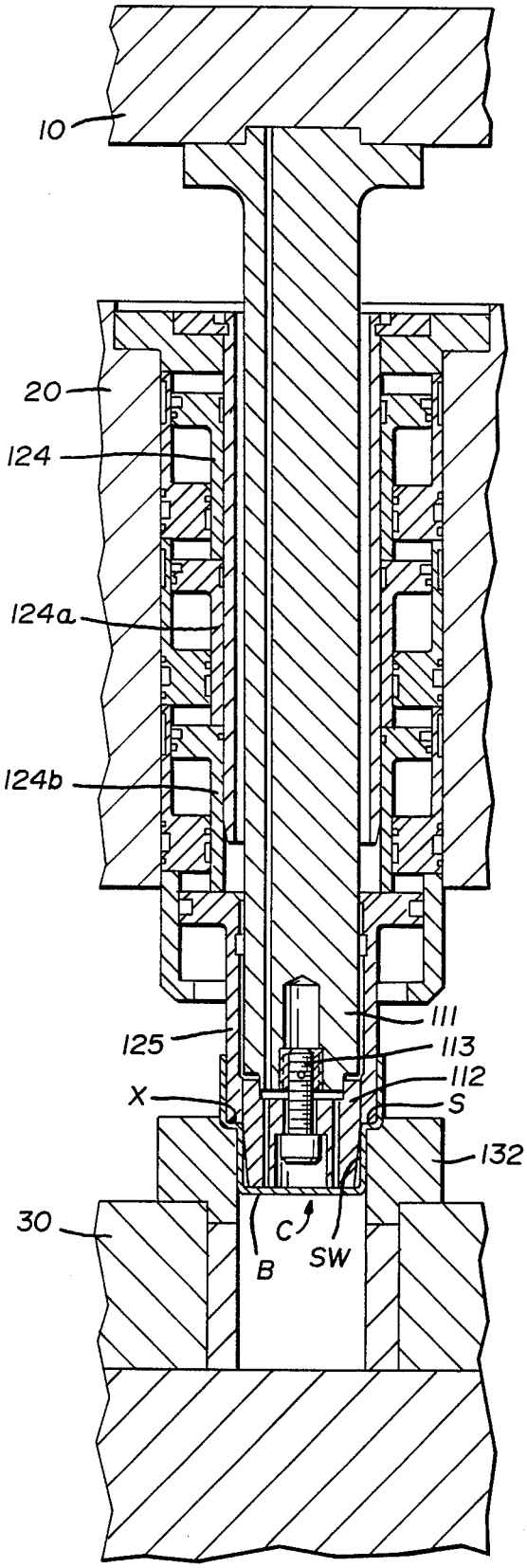
FIG. 10 is a sectional elevational view of the apparatus at the second station showing the first redraw of the cup.

Turning then to FIG. 10 which represents a second station, it will be assumed that the cup C has been removed from the first station as just described and transferred to the second station. A transfer mechanism is not illustrated herein, since there are a number of ways to accomplish the transfer.

Still referring to FIG. 10, it will be noted that the outer slide holder 20 of the press carries a series of stacked pistons 124, 124a and 124b which are fluidly actuated and which act on the pressure sleeve 125. The inner slide holder 10 of the press carries the die center riser 111 and has a first redraw die center 112 which is slightly longer than die center 12 and slightly tapered and which is secured to the riser by screw 113. A second redraw die 132 having a straight inner wall is also mounted on the base of the press, and it will be seen that by advancing the die center 112 toward the fixed base while holding the pressure sleeve 125 against the area X of the bottom B (see FIG. 3), effectively the cup C will be drawn to the configuration shown in FIGS. 3 and 10 of the drawings.

The cup is drawn here to a predetermined length and, as mentioned earlier, the shoulder S is left to supply material for further drawings. While die center 112 has a slight taper, it will be noted that while part of the drawing operation has now been completed, the sidewall SW is still straight. Since the wall of die 132 is straight, the metal tends to hug the wall and thus the sidewall SW of the cup stays essentially straight.

Figure 11:
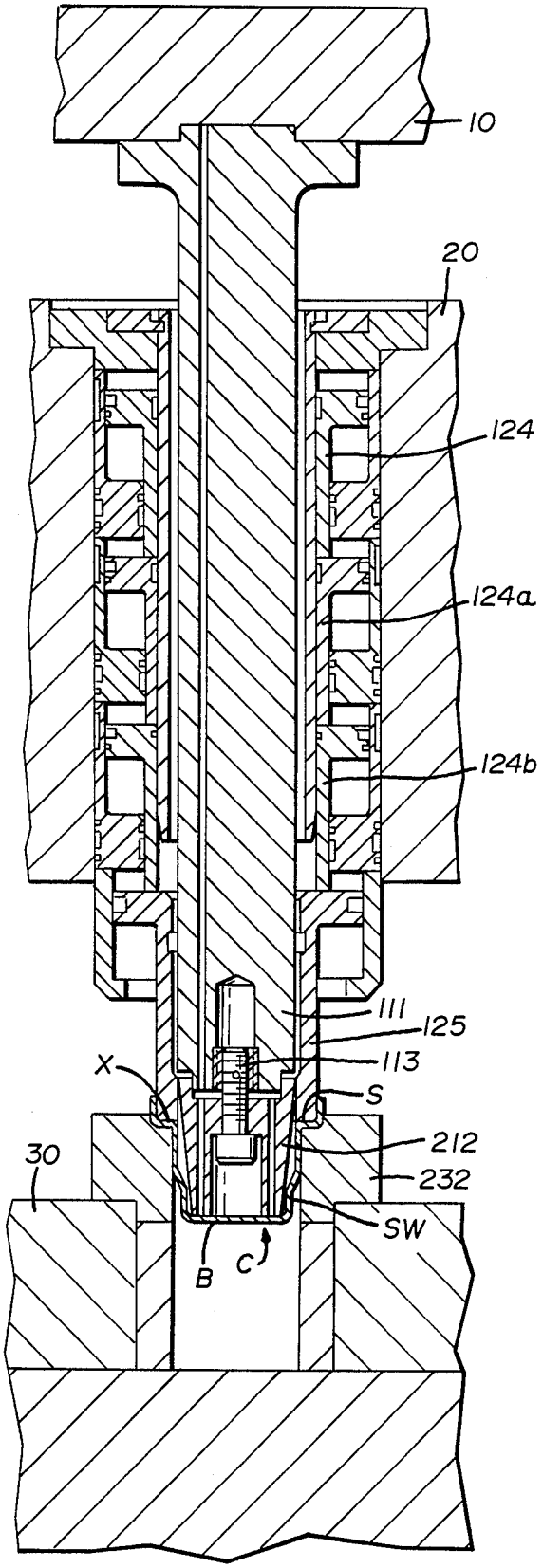
FIG. 11 is a sectional elevational view showing the position of the apparatus at the third station showing the second redraw of the cup with the sidewall still straight.

Turning then to FIG. 11 of the drawings which represents yet another station, it will be noted that a third redraw die 232, having a straight wall and a larger diameter than die 132 to permit completion of the next step, is provided on the fixed base 30 with the stacked piston arrangement and the pressure sleeve arrangement being the same as in FIG. 10. A different configuration of tapered die center 212 is employed, and it will be noted that further advance of the inner slide 10 and with it the die center 212 toward the base 30 will result in a configuration somewhat similar to that shown in FIG. 4 of the drawings wherein the sidewall is in the process of being stretched out and the tapered die center 212. It will also be noted that the sleeve 125 is in holding contact with the area X of shoulder S so as to control the wall thickness and metal flow.

At this point, some of the material in shoulder S has been used by not all of it and the transitional bead or wrinkle W remains and the sidewall portions above and below it are still straight.

Figure 12:
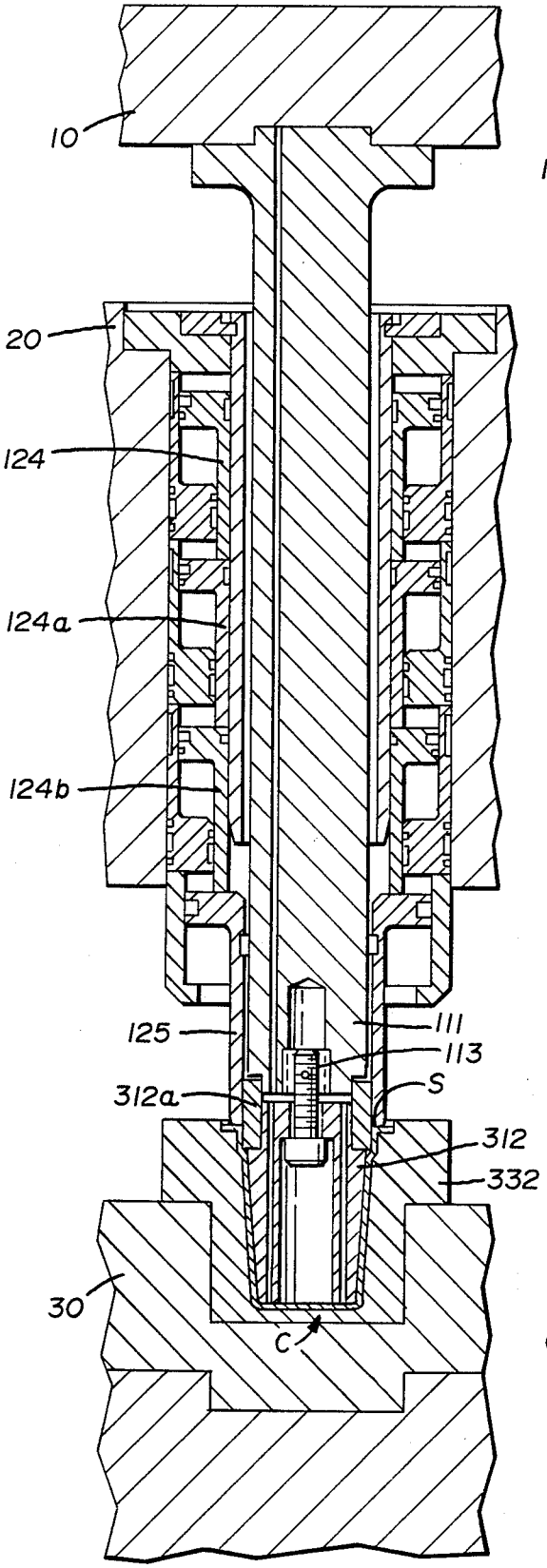
FIG. 12 is a sectional elevational view showing the position of the apparatus at the third station following the third redrawing of container and imparting of the taper to the sidewall.

FIG. 12 represents yet another station wherein the stacked piston arrangement of the pistons 124, 124a and 124b act on the pressure sleeve 125 in the fashion already described. The die center 312 is, of course, tapered and carried by the riser 111 to work in cooperation with the tapered and counterbored fourth redraw die 332 so as to effectively impart the configuration of FIG. 5 of the drawings to the container.

It will be noted that the counterboring of die 332, in cooperation with ring 312a on die center 312, also forms the annular external ridge R which eventually serves as an anvil for engagement with a conventional can opener once the container is completed as well as serving to locate or orient the usual descriptive label which will be applied to the outer surface.

It should be noted here that the taper of the sidewall is in the nature of 1.5°. A taper of this order has at least two advantages.

First, during forming, this smaller taper makes it possible to maintain control of the material and avoid wrinkling since the gaps between the inner die walls and outer die center walls are reduced.

Second, this reduced taper makes it possible to use the container in a conventional filling and labelling line without requiring any special handling or equipment and without sacrificing the stacking and nesting characteristics of the tapered container.

Figure 13:
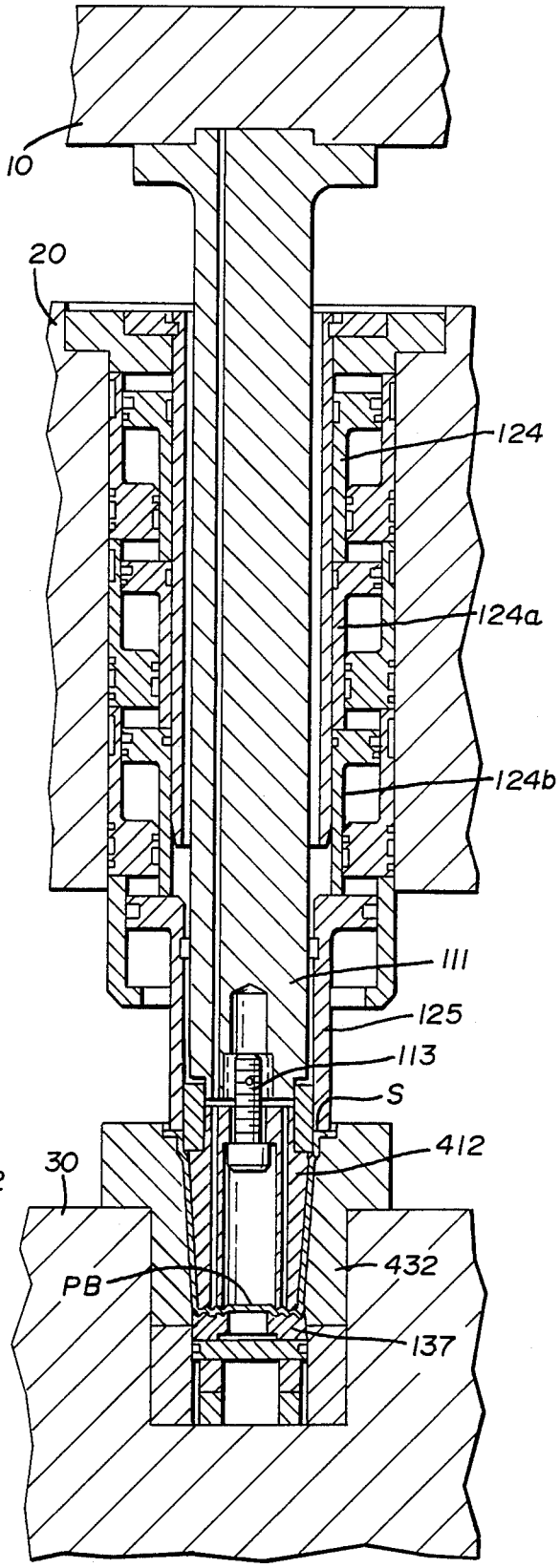
FIG. 13 is a sectional elevational view showing the position of the apparatus at a fourth station following final drawing and the optional profiling of the bottom of the container.

It will be noted that, if a profile is to be imparted to the bottom of the container as in FIG. 13, the container C would be drawn slightly overlength in FIG. 12.

Optionally then, the bottom can be profiled, as shown in FIG. 13. There, a profile pad 137 is provided on the fixed base 30 and, in cooperation with the redraw die 432 and the die center 412, the bottom can be profiled from the flat configuration B, for example, of FIG. 5 to the profiled configuration PB of FIG. 6.

Here, the ring (312a in FIG. 12) would seat against the shoulder formed in FIG. 12. This avoids pulling the shoulder out during profiling with it being understood that no drawing of the material is contemplated at this station.

The bottom is profiled by the interaction of die center 412 and profile pad 137 by folding the overlength material referred to above into the bottom. By holding at the shoulder with the ring and on the flange with sleeve 125, no material is drawn down the sidewall SW.

Figure 14:
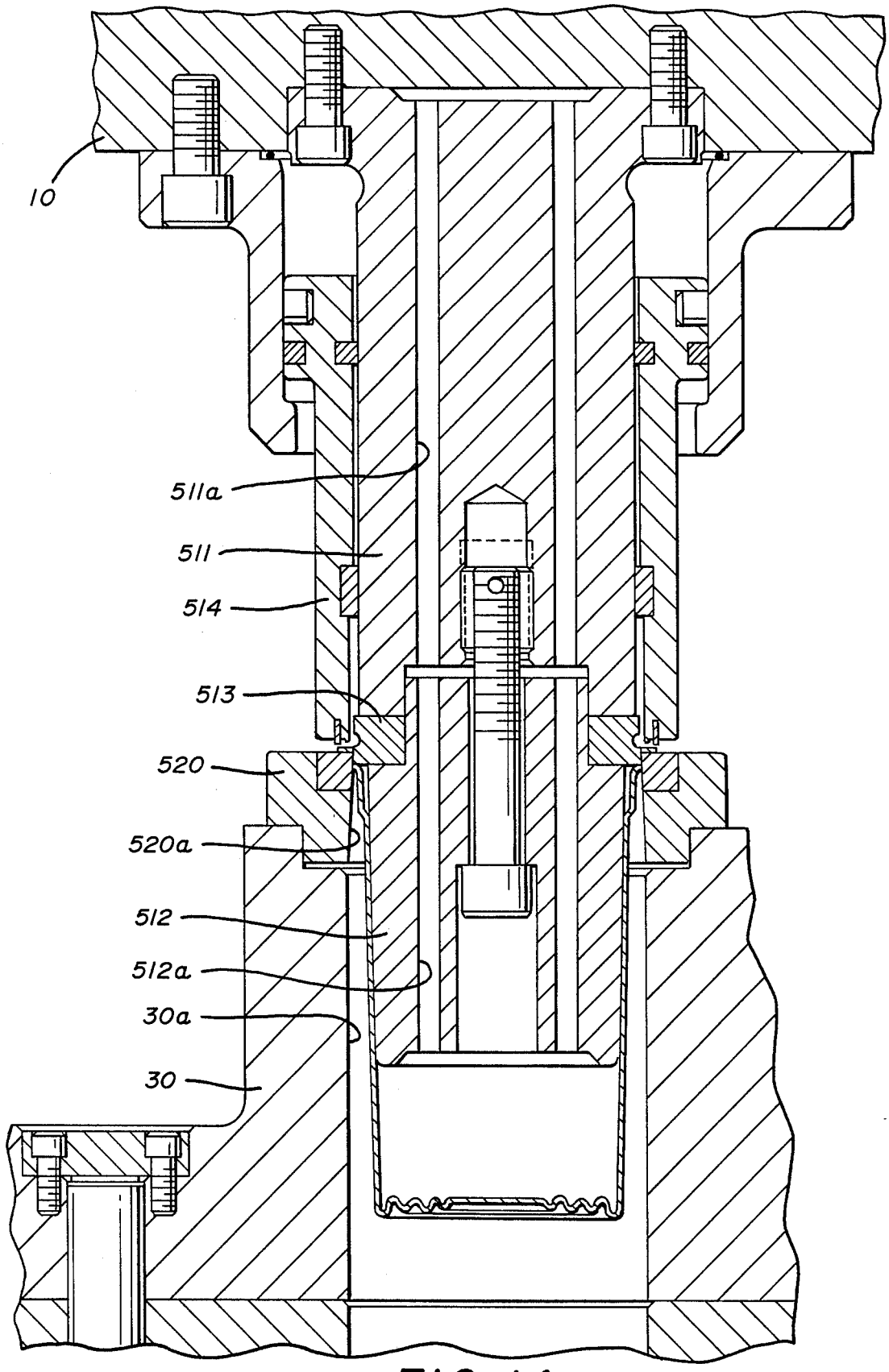
FIG. 14 is a sectional elevational view showing an optional trimming station and the position of the apparatus thereat.

It is also possible to provide yet another station as illustrated in FIG. 14 wherein the flange which is effectively part of the shoulder S can be trimmed, following which the container can be removed from the press and stacked for transportation to the filling site.

As can be seen in FIG. 14, this station includes a trim riser 511 carried by and projecting from slide 10. Secured thereto is trim pilot 512 which is tapered and has a length somewhat shorter than the depth of container C. Carried between riser 511 and pilot 512 is a trim cut edge 513. A trim sleeve 514 is also carried by slide 10 and located by trim sleeve retainer 514.

Base 30 carries a trim die 520 which, it will be noted, is annular in configuration and has a reverse taper 520a on its inner wall. Trim die 520 is mounted over die cavity 30a which is larger than container C.

The trimming operation is accomplished by advancing the container to the station, advancing slide 10 and pilot 512 toward base 30 and trimming the flange with trim cut edge 513 and trim die 520. Due to the reverse taper of wall 520a and the size of die cavity 30a, the trimmed container can be removed "through the die" by air directed through passages 511a and 512a in the riser 511 and pilot 512, respectively.

While a full and complete description of the invention has been set forth in accordance with the dictates of the Patent Statutes, it should be understood that modifications can be resorted to without departing from the spirit hereof or the scope of the appended claims.

For example, the profiling station is, of course, optional and the operations taking place in FIGS. 12 and 13 could be combined, particularly where a relatively shallow profile is involved.

Additionally, it should be noted that the containers involved herein, while primarily for use in the food and beverage industries, are usable in a wide variety of industries.

What is claimed is:

1. Apparatus for forming a tapered container from a preformed cup, comprising:

(A) at a first station, a die having a substantially straight walled cavity;

(B) a die center having a tapered periphery;

(C) a fluidly actuated pressure sleeve movable toward and away from said die;

(D) said pressure sleeve engaging the bottom of the cup upon movement toward said die;

(E) said die center being movable toward said die to engage the cup and draw the same, in cooperation with said die, into a partial length container having first and second substantially straight sidewall portions interconnected by a transition portion;

(F) at a second station, a second die having a substantially straight walled cavity;

(G) a second die center having a tapered periphery and being movable toward said second die to further elongate said container while maintaining said first and second substantially straight sidewall portions and at least a part of said transition portion;

(H) at a third station, a third die having a tapered die cavity; and (I) a third die center having a tapered periphery and being movable toward said third die to further elongate said container and impart a taper to the sidewall thereof.

2. The apparatus of claim 1 wherein said cavity of said second die has a larger diameter than said cavity of said first die.

3. The apparatus of claim 1 wherein the taper of said third die center is approximately 1.5°.

4. The apparatus of claim 1 wherein, at a fourth station, a fourth die having a tapered die cavity and a profile pad located at its bottom is provided; a fourth tapered die center being provided at said fourth station and being movable toward said fourth die to impart a profile to the bottom of said container.

5. The apparatus of claim 4 wherein, at a fifth station, a trim die is provided; and a trim die pilot and cut edge are provided for movement toward said trim die.

6. Apparatus for forming a tapered container from a blank of material, comprising:

(A) at a first station, a fixed redraw die;

(B) a blank and draw punch, movable toward and away from said redraw die;

(C) a die center movable toward and away from said redraw die;

(D) said blank and draw punch wiping the blank over the top of the redraw die upon movement toward said redraw die to form an inverted cup;

(E) said die center engaging said inverted cup and reverse drawing the same upon movement toward said redraw die;

(F) said redraw die being hollow whereby said reverse drawn cup may be removed from the die through the die;

(G) at a second station, a die having a substantially straight walled cavity;

(H) a die center having a tapered periphery;

(I) a fluidly actuated pressure sleeve movable toward and away from said die;

(J) said pressure sleeve engaging the bottom of the cup upon movement toward said die;

(K) said die center being movable toward said die to engage the cup and draw the same, in cooperation with said die, into a partial length container having first and second substantially straight sidewall portions interconnected by a transition portion;

(L) at a third station, a third die having a substantially straight walled cavity;

(M) a third die center having a tapered periphery and being movable toward said third die to further elongate said container while maintaining said first and second substantially straight sidewall portions and at least a part of said transition portion;

(N) at a fourth station, a fourth die having a tapered die cavity; and (O) a fourth die center having a tapered periphery and being movable toward said fourth die to further elongate said container and impart a taper to the sidewall thereof.

7. The apparatus of claim 6 wherein said cavity of said third die has a larger diameter than said cavity of said second die.

8. The apparatus of claim 6 wherein the taper of said fourth die center is approximately 1.5°.

9. The apparatus of claim 6 wherein, at a fifth station, a fifth die having a tapered die cavity and a profile pad located at its bottom is provided; a fifth tapered die center being provided at said fifth station and being movable toward said fifth die to impart a profile to the bottom of said container.

10. The apparatus of claim 9 wherein, at a sixth station, a trim die is provided; and a trim die pilot and cut edge are provided for movement toward said trim die.

* * * * *

UNITED STATES PATENT AND TRADEMARK OFFICE

CERTIFICATE OF CORRECTION

PATENT NO. : 4,782,685

DATED : November 8, 1988

INVENTOR(S) : Bulso, Jr., et al.

It is certified that error appears in the above-identified patent and that said Letters Patent are hereby corrected as shown below:

On the first page of the soft copy under the heading "ABSTRACT", in the fourth line of the paragraph, delete "position" and substitute therefor --portion--.

Signed and Sealed this

Twenty-eighth Day of March, 1989

*Attest:*

DONALD J. QUIGG

*Attesting Officer*

*Commissioner of Patents and Trademarks*